US007323985B2

(12) United States Patent
Ben-Asher

(10) Patent No.: US 7,323,985 B2
(45) Date of Patent: Jan. 29, 2008

(54) ELECTRONIC WARNING SYSTEM AND METHOD

(75) Inventor: Eldad Ben-Asher, Ramat Hasharon (IL)

(73) Assignee: El-Far Electronics Systems 2000 Ltd., Magshimim (IL)

( * ) Notice: Subject to any disclaimer, the term of this patent is extended or adjusted under 35 U.S.C. 154(b) by 376 days.

(21) Appl. No.: 11/006,613

(22) Filed: Dec. 8, 2004

(65) Prior Publication Data

US 2006/0103527 A1 May 18, 2006

(30) Foreign Application Priority Data

Oct. 28, 2004 (IL) ..... 164891

(51) Int. Cl.
*G08B 13/00* (2006.01)

(52) U.S. Cl. ..... 340/541; 340/564; 340/635; 340/657

(58) Field of Classification Search ..... 340/541
See application file for complete search history.

(56) References Cited

U.S. PATENT DOCUMENTS

| | | | | |
|---|---|---|---|---|
| 3,375,511 | A * | 3/1968 | Trimble et al. | 340/561 |
| 4,523,185 | A * | 6/1985 | Roth | 340/524 |
| 4,622,541 | A | 11/1986 | Stockdale | |
| 5,705,984 | A * | 1/1998 | Wilson | 340/561 |
| 6,577,236 | B2 * | 6/2003 | Harman | 340/552 |
| 6,853,301 | B2 * | 2/2005 | Devine | 340/571 |

FOREIGN PATENT DOCUMENTS

| | | |
|---|---|---|
| FR | 2 314 545 | 1/1977 |
| GB | 2 221 990 | 2/1990 |
| IL | 87 071 | 11/1990 |

* cited by examiner

*Primary Examiner*—George Bugg
(74) *Attorney, Agent, or Firm*—Stites & Harbison, PLLC; Ross F. Hunt, Jr.

(57) ABSTRACT

The invention provides an electronic warning system, including an electrical line of a fence extending along a protected area; a pulser; a transmitter for transmitting pulses through the line; a receiver for receiving the pulses after being transmitted along at least a portion of the line; an impedance having a resistance substantially identical to the line characteristic resistance and connected at the end of the line, for absorbing the pulses when the pulses are received thereby at the end of the line so that the pulses do not return to the receiver; a plurality of sensors disposed at spaced-apart locations along the line and actuated responsive to phenomenon occurring in the vicinity thereof, for, when actuated, causing the pulses to return to the receiver; and a processor for operating the transmitter and receiver and for actuating a warning signal upon the detection, by at least one of the sensors, of the phenomenon. The processor has means for determining the time taken by a the pulse to return to the receiver in response to the actuation of the sensor so as to determine the location of the actuated sensor and thus determining the location at which the phenomenon occurred; characterized in that the processor further includes means for presetting and determining the number of pulses received during a preset period of time from receipt of a first pulse, resulting from an occurrence and repeated occurrences of the phenomenon at the same location, and for actuating a warning signal beyond the number of pulses. A method for distinguishing between false alarms and true unauthorized activity along a fence or at the vicinity thereof, is also provided.

5 Claims, 3 Drawing Sheets

ELECTRONIC WARNING SYSTEM AND METHOD

FIELD OF THE INVENTION

The present invention relates electronic warning systems and more particularly to electronic intrusion detection systems extending along a fence, protecting against unauthorized activity on, and in the vicinity of, the fence.

BACKGROUND OF THE INVENTION

The prior art, FIG. 1 of Israel Patent 87071 describes an electronic warning system composed of two main portions: a central control unit 2 and a line 4 in a fence. The central control unit 2 includes a timer 6 governing the operation of a transmitter 8 electrically connected to the line 4 and of a counter 10 driven by an oscillator 12. A receiver 14 also connected to the fence 4 and arranged in circuit for actuating an alarming unit 16 and for activating the counter 10. The latter operates a time-to-distance translator 18, which translates the signal received by the receiver into distances measured from any reference point and displays the same on a suitable display unit 20.

The line 4, stretchable along a practical distance of up to about 1000 meters from each side of the central control unit 2, is composed of a pair of wires 22 interconnected at their ends by a resistor 24 and of a plurality of sensors 26, e.g., inertial sensors. The sensors 26 can be connected to the wires 22 in series, in parallel, or in a combined series and parallel fashion. The sensors 26 are spaced-apart from each other at typical distances of between 3 to 5 meters. Satisfactory detection results were obtained with the usage of sensors detecting and responding to vibrations or to changes in volume, operating in the ultrasonic or infrared frequency ranges. The resistor 24 is chosen to possess resistance, which is substantially identical to the characteristic resistance of the fence.

The teachings of the above-described Israel Patent are incorporated herein by reference.

Experience with this and other warning systems has shown that the rate of false alarms caused by wind, rain or hail, animals, birds and the like, is high, thus imposing an unnecessary burden on the guards.

DISCLOSURE OF THE INVENTION

It is therefore a broad object of the present invention is to ameliorate the disadvantages of such known warning systems and to provide an intrusion detection warning system and method for reducing the rate of false alarms, as compared with the prior art known systems.

It is a further object of the present invention to provide an intrusion detection system and method which assist the security personnel in pinpointing the location of actual intrusion attempts, as opposed to alarms initiated by non-intruding influences.

In accordance with the present invention, there is therefore provided an electronic warning system, comprising an electrical line of a fence extending along a protected area; a pulser; a transmitter for transmitting pulses through said line; a receiver for receiving said pulses after being transmitted along at least a portion of said line; an impedance having a resistance substantially identical to the line characteristic resistance and connected at the end of said line, for absorbing said pulses when said pulses are received thereby at the end of said line so that said pulses do not return to said receiver; a plurality of sensors disposed at spaced-apart locations along said line and actuated responsive to phenomenon occurring in the vicinity thereof, for, when actuated, causing said pulses to return to said receiver; a processor for operating said transmitter and receiver and for actuating a warning signal upon the detection, by at least one of said sensors, of said phenomenon, said processor including means for determining the time taken by a said pulse to return to said receiver in response to the actuation of a said sensor so as to determine the location of the actuated sensor and thus determine the location at which the phenomenon occurred; characterized in that said processor further includes means for presetting and determining the number of pulses received during a preset period of time from receipt of a first pulse, resulting from an occurrence and repeated occurrences of said phenomenon at the same location, and for actuating a warning signal beyond said number of pulses.

The invention further provides a method for distinguishing between false alarms and true unauthorized activity along a fence or at the vicinity thereof, comprising: providing an electronic warning system including an electrical line of a fence extending along a protected area; a pulser; a transmitter for transmitting pulses through said line; a receiver for receiving said pulses after being transmitted along at least a portion of said line; an impedance having a resistance substantially identical to the line characteristic resistance and connected at the end of said line, for absorbing said pulses when said pulses are received thereby at the end of said line so that said pulses do not return to said receiver; a plurality of sensors disposed at spaced-apart locations along said line and actuated responsive to phenomenon occurring in the vicinity thereof, for, when actuated, causing said pulses to return to said receiver; setting a number "n" of repeatedly received pulses within a preset period of time; transmitting pulses of a number equal to or greater than "n"; counting the number of pulses received within said preset period of time; determining whether the number received equals the number "n", and if it is at least equal, actuating a warning signal.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a block circuit diagram of a prior art electronic warning system;

FIG. 2 is a block circuit diagram of an electronic intrusion detection system according to the invention, and FIG. 3 is a more detailed block diagram also displaying the method of operation.

DETAILED DESCRIPTION OF PREFERRED EMBODIMENTS

Figure 1:
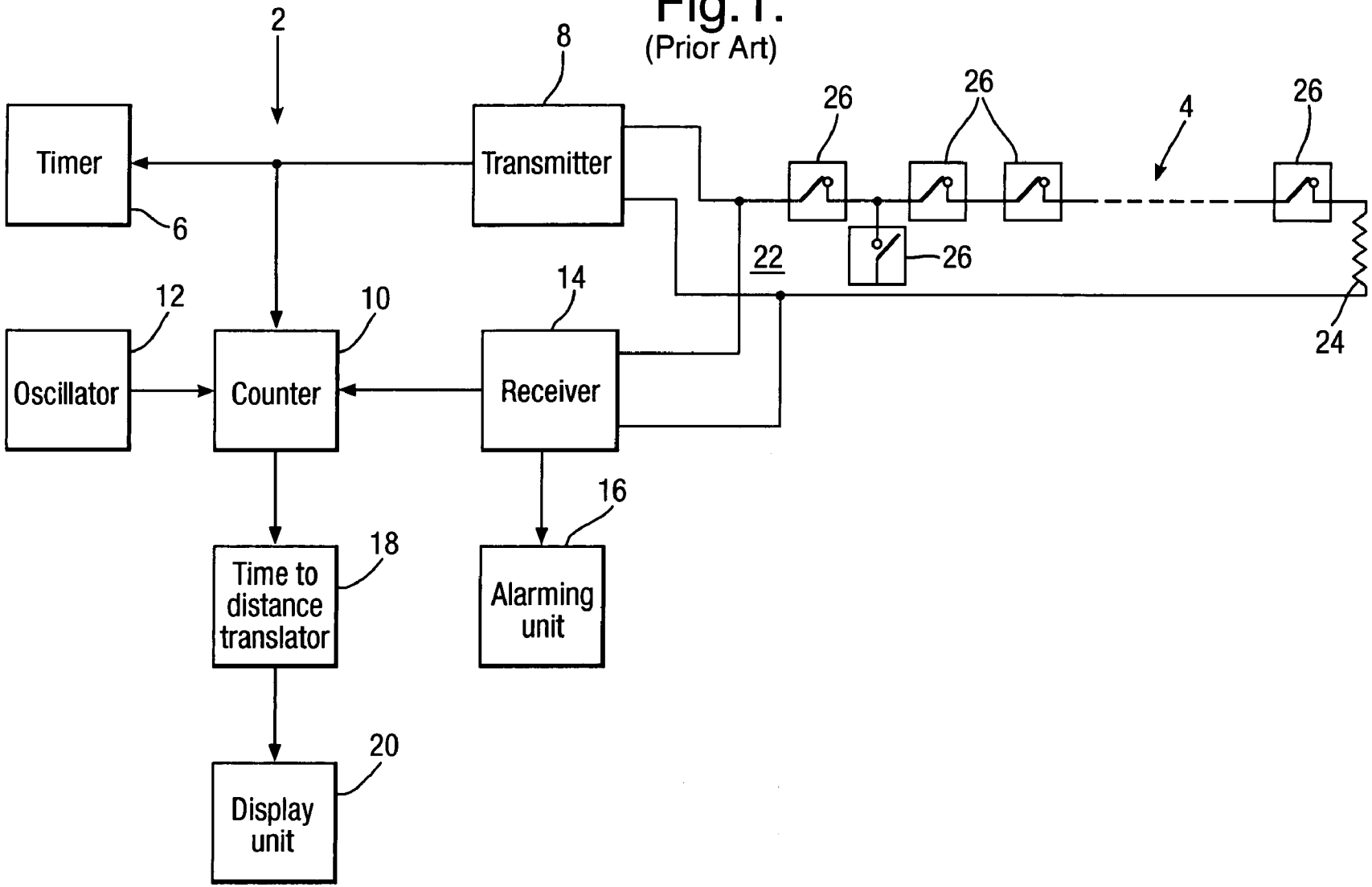
Fig.1. (Prior Art)
Figure 2:
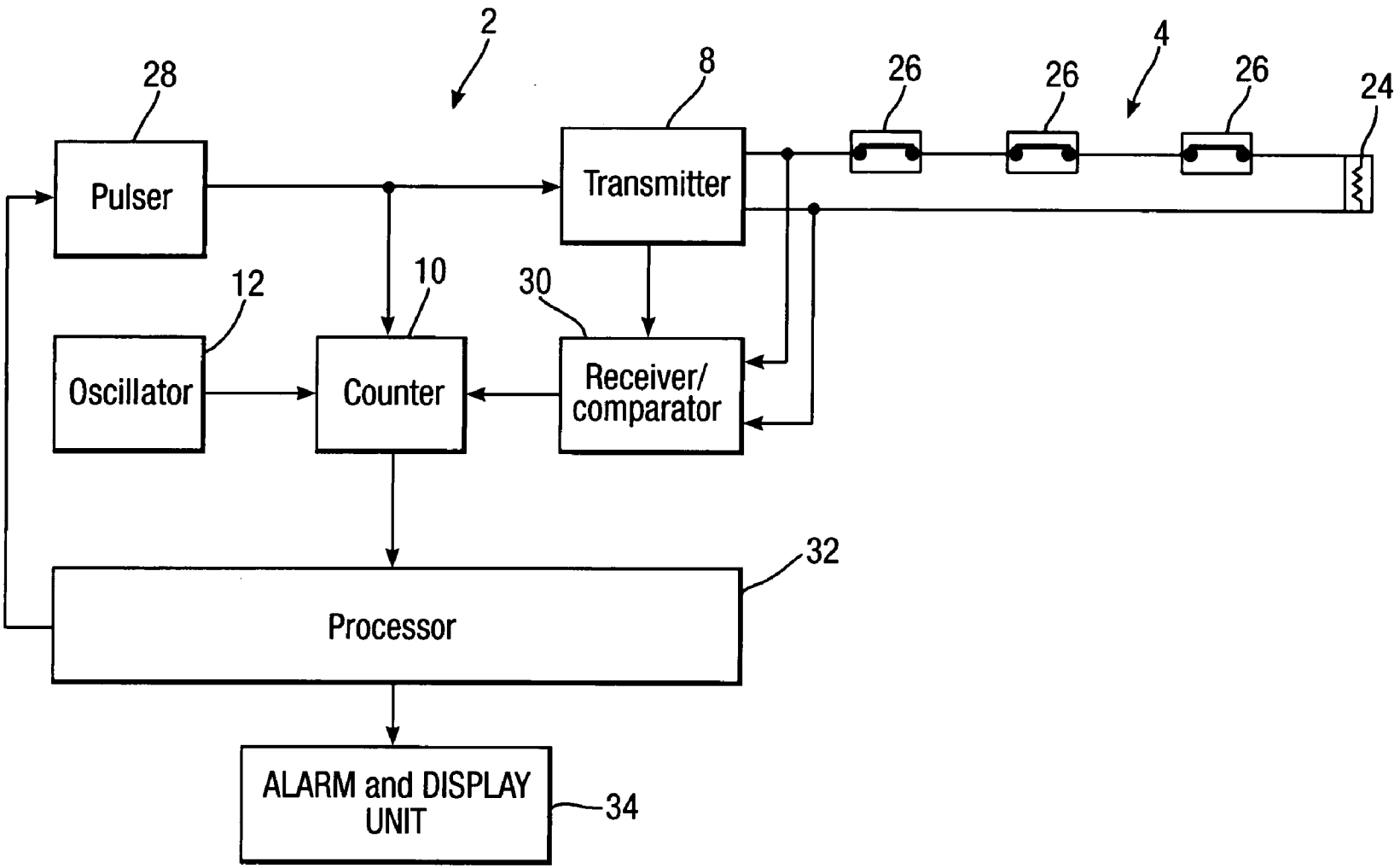

Referring to FIG. 2, there is illustrated the intrusion detection system according to the present invention in which a pulser 28 actuated by the processor 30 activates the transmitter 8 for a duration of e.g., two microseconds. The transmitter 8 transmits a pulse of a predetermined width to the sensors 26. The time counter 10 counts the pulses emitted by the oscillator 12 from the instant that the pulse is transmitted to the line 4, until the instant of the identification of the returning pulses, by the receiver/comparator 30. The processor 32 then decides whether or not to send a pre-alarm signal to the alarm and display unit 34.

Figure 3:
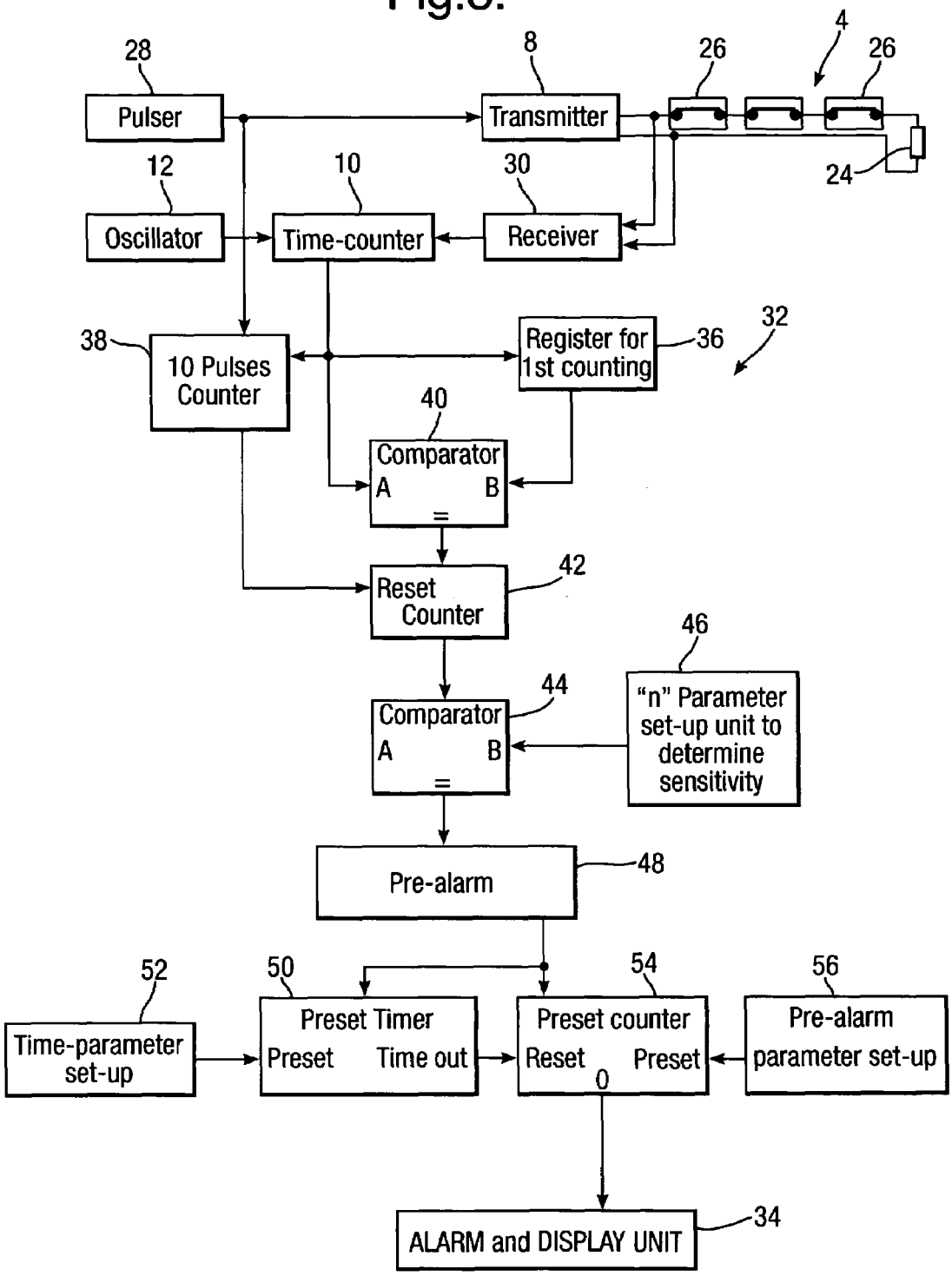

Referring now to FIG. 3 for better understanding the functions of the processor 32 are shown separately. When there is received a first returning pulse, namely a pulse which is not absorbed by the resistor 24, the time of return is registered in the register 36. The latter will activate the pulse counter 38 for counting, e.g., 10 consecutive pulses. The comparator 40 will then determine whether each of the pulses originates at the same fence section, by comparing its time of arrival to the time of the first pulse. Should the comparator 40 will determine that this is the case, the pulse will be fed via the reset counter 42 to the comparator 44 for comparing the number of pulses received with the number set by the "n" parameter set-up unit 46, which determines and presets the sensitivity of the system. When the preset number "n" is reached, the comparator 44 sends a signal to the pre-alarm unit 48. The latter will initiate the preset timer 50 for a duration as set by the time parameter set-up 52 and the preset counter 54. If the number of pulses counted by the pre-alarm parameter set-up 56 is equal to or greater than the set number "n" before the termination of time in the preset timer 50, the preset counter 54 will activate the alarm and/or display unit 34. If, however, the preset timer 50 will terminate the counting before the termination of that number by the pre-alarm parameter set-up 56, the preset counter 54 will be reset, an alarm will not be activated and the counting will recommence.

The above technique will prevent false alarms, since only return pulses which are counted during a predetermined period of time from a first return pulse, will effect the sounding of an alarm. This predetermined period of time represents a predetermined length along a fence, e.g., a length of 20 m, which provides a workable degree of accuracy.

It should be understood that the system can simultaneously handle "events" occurring at different sections along the fence, each having a different pulse return time. The processor 32 will govern the reset time of events which will not reoccur within the preset number of times "n". Thus, when the system detects several events which took place at the same time at several locations along the fence, and if the number of events exceeds a preset number, then the system is reset under the understanding that these events occurred due to weather conditions, e.g., a storm. After reset, the count of events commences as described hereinabove.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electronic warning system, comprising:

an electrical line of a fence extending along a protected area;

a pulser;

a transmitter for transmitting pulses through said line;

a receiver for receiving said pulses after being transmitted along at least a portion of said line;

an impedance having a resistance substantially identical to the line characteristic resistance and connected at the end of said line, for absorbing said pulses when said pulses are received thereby at the end of said line so that said pulses do not return to said receiver;

a plurality of sensors disposed at spaced-apart locations along said line and actuated responsive to phenomenon occurring in the vicinity thereof, for, when actuated, causing said pulses to return to said receiver;

a processor for operating said transmitter and receiver and for actuating a warning signal upon the detection, by at least one of said sensors, of said phenomenon, said processor including means for determining the time taken by a said pulse to return to said receiver in response to the actuation of a said sensor so as to determine the location of the actuated sensor and thus determine the location at which the phenomenon occurred;

characterized in that said processor further includes means for presetting and determining the number of pulses received during a preset period of time from receipt of a first pulse, resulting from an occurrence and repeated occurrences of said phenomenon at the same location, and for actuating a warning signal beyond said number of pulses.

2. The system as claimed in claim 1, wherein said means include a pulse counter receiving signals from said pulser.

3. The system as claimed in claim 1, wherein said processor includes a comparator for comparing the number of pulses received during a predetermined duration of time and a preset number.

4. A method for distinguishing between false alarms and true unauthorized activity along a fence or at the vicinity thereof, comprising:

providing an electronic warning system including an electrical line of a fence extending along a protected area; a pulser; a transmitter for transmitting pulses through said line; a receiver for receiving said pulses after being transmitted along at least a portion of said line; an impedance having a resistance substantially identical to the line characteristic resistance and connected at the end of said line, for absorbing said pulses when said pulses are received thereby at the end of said line so that said pulses do not return to said receiver; a plurality of sensors disposed at spaced-apart locations along said line and actuated responsive to phenomenon occurring in the vicinity thereof, for, when actuated, causing said pulses to return to said receiver;

setting a number "n" of repeatedly received pulses within a preset period of time;

transmitting pulses of a number equal to or greater than "n";

counting the number of pulses received within said preset period of time;

determining whether the number received equals the number "n", and if it is at least equal, actuating a warning signal.

5. The method as claimed in claim 4, further comprising:

presetting a number of events which occur simultaneously at different parts of the line;

determining if the number of said events exceeds said preset number, and if it exceeds, reset the system.

* * * * *